United States Patent [19]

Farmer et al.

[11] 4,004,439

[45] Jan. 25, 1977

[54] PATTERN MECHANISM

[75] Inventors: Ernest Leonard Farmer; Peter Michael Findlay, both of Leicester, England

[73] Assignee: Wildt Mellor Bromley Limited of Adelaide Works, Leicester, England

[22] Filed: Aug. 30, 1971

[21] Appl. No.: 176,166

Related U.S. Application Data

[63] Continuation-in-part of Ser. No. 813,548, April 4, 1969, abandoned.

[30] Foreign Application Priority Data

Apr. 5, 1968 United Kingdom ..... 16558/68
Dec. 19, 1968 United Kingdom ..... 60457/68

[52] U.S. Cl. ..... 66/154 A; 66/50 R
[51] Int. Cl.² ..... D04B 15/78
[58] Field of Search ..... 66/50 R, 25, 154 A

[56] References Cited

UNITED STATES PATENTS

| | | | |
|---|---|---|---|
| 3,423,960 | 1/1969 | Wiesinger et al. | 66/25 |
| 3,461,690 | 8/1969 | Martinetz et al. | 66/50 R |
| 3,470,714 | 10/1969 | Corbaz | 66/50 R |
| 3,550,398 | 12/1970 | Widdowson | 66/50 R |
| 3,653,229 | 4/1972 | Gottsching | 66/50 R |
| 3,665,731 | 5/1972 | Groezinger | 66/50 R |

*Primary Examiner*—Mervin Stein
*Assistant Examiner*—Andrew M. Falik
*Attorney, Agent, or Firm*—Irving M. Weiner; Pamela S. Austin

[57] ABSTRACT

A pattern control arrangement for a knitting machine comprising a pattern band, magnetic tape or the like, reading means for reading the band, tape or the like and providing pulses for operation selectors movable into or out of butt-engaging position for controlling the positions of butts on or associated with needles, wherein the reading means includes means to provide pulses for moving selectors into butt-engaging position in accordance with information carried by the band, tape or the like, and means to provide pulses to move the selectors out of butt-engaging position when not required to remain in such position.

3 Claims, 14 Drawing Figures

INVENTOR
ERNEST LENARD
BY FARMER ETAL
ATTORNEYS

INVENTOR
ERNEST LENARD
BY FARMER ETAL
ATTORNEYS

INVENTOR
ERNEST LENARD
BY FARMER ETAL

ATTORNEYS

INVENTOR
ERNEST LENARD
BY FARMER ETAL.

ATTORNEYS

INVENTOR
ERNEST LENARD
BY FARMER ETAL.

ATTORNEYS

INVENTOR
ERNEST LENARD
BY FARMER ETAL

ATTORNEYS

INVENTORS
ERNEST LEONARD FARMER
PETER MICHAEL FINDLAY
BY
Irving M. Weiner
ATTORNEY

PATTERN MECHANISM

This application is a continuation-in-part of our copending application Ser. No. 813,548 filed on Apr. 4, 1969, now abandoned.

This invention relates to knitting machines and more particularly to pattern control arrangements for knitting machines.

While the invention will be particularly described with reference to multi-feed circular knitting machines of the type in which the needle cylinder rotates within a stationary cam box, it will be appreciated that the basic teaching of the invention is applicable to circular knitting machines with a stationary needle cylinder and a rotating cam box, and also to knitting machines of the straight bar type or of the flat bed type.

In general, knitting machines include a number of needles which sequentially enter each yarn feed zone and means are provided to pre-select the position of each needle as it enters the yarn feed zone so that it will knit, make a tuck stitch or miss taking the yarn which will then float across the needle without forming a stitch. The needles are generally positioned by means of butts formed on or associated with the needles and which cooperate with selectors adapted to be reciprocated between butt-engaging and butt-missing positions. Generally if a selector is in butt-engaging position, the needle or an associated jack is depressed into the needle trick or groove so that the needle is not moved by the cam or a combination of cams, out of the miss (normal retracted) position into either the tuck or knit position.

It is necessary to provide for control of the position of each needle prior to its entering each feed zone and while a single selector may be provided at each position, the time available for moving the selector into and out of butt-engaging position is very short, so that very high precision in timing is required. This leads to high manufacturing costs. For this reason, it is normal for a group of selectors to be stacked into a selector unit to co-operate at different levels and to divide the needles into groups of the same number, with each needle group having one butt at each of the levels of the selectors in the unit. The butts on or associated with successive needles may be disposed in a diagonal arrangement and actuation of all the selectors in a group may be effected between the arrivals of successive needles at the particular level so an increased time is made available for each operation of selection.

It is normal practice for the selectors to be electromagnetically operated to butt-engaging position with a spring return. However the application of electronic processing to the control pulses from a pattern band or other pattern control has led to an increase in the processing speed and thus the time taken for a spring return action is a limiting factor on the time of operation and hence on the speed at which the machine may be run. If the spring return is speeded up by increasing the strength of the spring, there is a tendency to bounce so that the full advantage of speed is not attained. Also, the increasing of the strength of the spring leads to a need for increased power for the operating solenoid, which increases the cost thereof and also leads to the necessity for high currents to be provided and switched by the electronic controls, thus further increasing the cost.

Accordingly the invention consists in a pattern control arrangement for a knitting machine comprising in combination needles, cam means for lifting said needles, cam-engaging butts associated with said needles, butts for controlling the location of said cam-engaging butts in or out of cam-engaging position, selectors for engaging said controlling butts, a pattern band, magnetic tape or the like carrying information spots, reading means for moving said selectors into or out of butt-engaging position in accordance with said information spots on said pattern band, tape or the like, said reading means including means for providing pulses for moving said selectors into butt-engaging position when required to move into or remain in that position and also means for providing pulses to move said selectors out of butt-engaging position when required to move out of or remain out of that position, drive means for said pattern band, tape or the like, carrier means driven by said drive means and having secondary information spots thereon which are adapted to be read by the reading means to act as the source of said pulses for moving said selectors out of butt-engaging position, said selectors being arranged in groups of which one selector is to be actuated at each reading of said pattern band, tape or the like, said carrier means having said secondary information spots arranged thereon in a number of rows equal to the number of selectors in each group, the reading means includes a logic amplifier for each selector, the said logic amplifier having a first input from the principal information spots on the pattern band, tape or the like and relating to the pattern, and a second input from the said secondary information spots arranged in a number of rows equal to the number of selectors in a group, the said logic amplifier being such as to give an amplified output following detection of a second input, the polarity of the amplified outputs being controlled by the detection of the existence or otherwise of a signal at the first input, there being no amplified output if no signal is detected at the second input.

The increased speed and reliability arising from electromagnetic operation of the selectors in both directions enables the machine to be operated at a speed at or near its maximum capability.

Suitable forms of selector for use in conjunction with this type of pattern control are described in U.S. Pat. No. 3,550,398, which is owned by the assignee of the present application.

In that patent, each of the selectors of the or each patterning unit is so mounted for movement as to enable the leading portion thereof to be moved from an inoperative position in which it is prevented from influencing patterning butts on knitting instruments into an operative position either for direct action or to effect indirect action upon such butts, and vice versa, and there are provided on or wholly or partly around each selector an electromagnetic means adapted to be so electrically pulsed in opposite directions as to cause the selector, by mutual attraction of the electromagnetic means and permanent magnetic means, taking place at opposite sides of the said selector, to be moved to and held by the permanent magnetic means in its operative and inoperative positions respectively.

It is preferred that a pulse to move the selectors out of butt-engaging position (hereinafter referred to as a negative pulse, although the polarity is immaterial) be provided in all cases where a pulse to move the selector into butt-engaging position (hereinafter referred to as a positive pulse, although the polarity is immaterial) is not provided.

In a typical multi-feed circular knitting machine with a rotating needle cylinder, say of 1728 needles, there could be 36 feed points each having an associated group of six selectors. A pattern band or magnetic tape for such a machine would have 36 rows of information spots (holes or blanks) to provide sources of positive pulses and may also include a further single row of information spots to provide a source of negative pulses. At each reading stage one information spot from each of the 36 rows would be read and the holes would give rise to positive pulses to operate selectors in the groups associated with the rows. The single row of holes would give rise to negative pulses at the appropriate selectors in the other groups, when a blank appeared in the 36 rows. Some form of sequencing arrangement then routes the pulses arising from the succeeding lines of 36 information spots to other selectors in each group so that each selector would only be associated with one line out of six.

In a preferred alternative, the negative pulses are derived from information spots on a drum driven by or forming part of the pattern band drive mechanism.

Further, the drum may have the information spots, such as holes, arranged in a number of rows equal to the number of selectors in a group so that sequential routing of the pulses may be achieved without additional cycling pulses.

In a still further alternative, the information spots for the negative pulses may be arranged on the pattern band or tape in a number of rows equal to the number of selectors in a group.

When the butts are arranged in diagonal lines and the selectors are also staggered, it may be preferable to store the impulses and to operate all of the selectors together. This may be done by providing a holding stage in the electronic circuitry and arranging for the pulsing of the last (sixth) selector in each group to operate the other selectors by triggering the stored pulses.

The invention will be further described with reference to the accompanying drawings of a preferred embodiment of the invention, and wherein.

Figure 1:
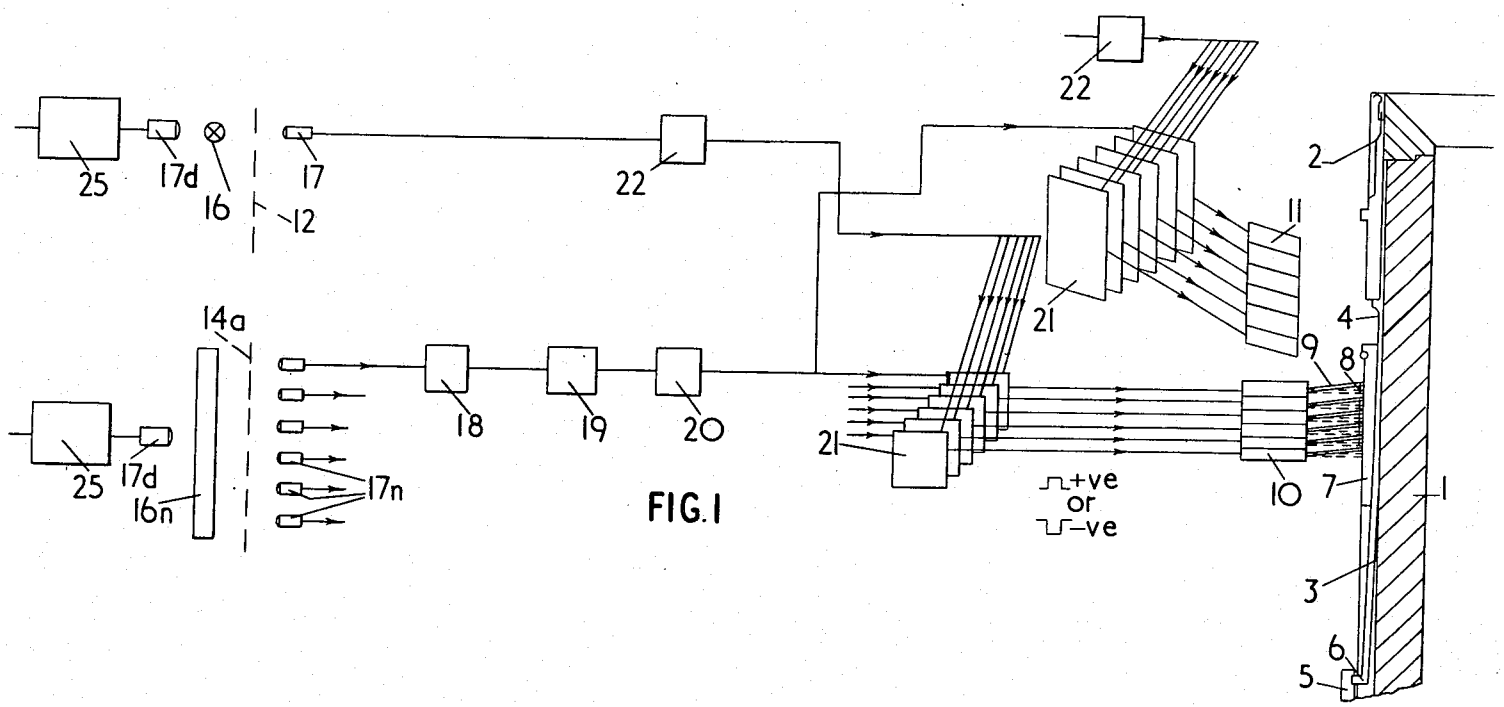
FIG. 1 is a block diagram illustrating the circuitry connecting a pattern band with the needle selector and also illustrating in section, one needle and associated parts.

Referring first to FIG. 1, it will be seen that the right hand portion of this Figure illustrates a portion of a rotating needle cylinder 1 and shows one needle 2 in its associated needle trick 3, in which also slides a jack 4 for moving the needle between miss and knit positions under the influence of a lifting cam 5 cooperating with an actuating butt 6 on the jack. When it is desired that the needle should remain in the miss position, it is necessary for the butt 6 to be retracted into the trick 3 so that it does not engage the lifting cam 5. The jack is inherently resilient so as to urge the butt 6 outwardly from the trick, and in order to overcome this inherent resilience, a rocking presser 7 is associated with each individual jack 4, and carries a selecting butt 8 at one of the six levels illustrated. The other five butts shown are those on the rocking pressers associated with the other needles in a group of six, and it can be seen that each of these is at a different level. The selecting butt 8 co-operates with selectors 9 which are rockable between the positions shown in full lines wherein they fail to engage their associated butts 8, and the positions shown dotted whereby they do engage the butts as the cylinder 1 rotates and rock the associated pressers 7 so as to depress the butt 6 on the jack 4 into the trick 3.

The selector elements shown may be of one of the types set out in the above mentioned U.S. Pat. No. 3,550,398, to which reference may be made for a full disclosure of the constructional details thereof, and the description and drawings of which are hereby imported into the present specification.

A group of selector elements as described above will be associated with each feed station of a multi-feed circular knitting machine with a movable needle cylinder, and one group of such selector elements is illustrated at 10 and a second one spaced therefrom is illustrated at 11.

Figure 2:
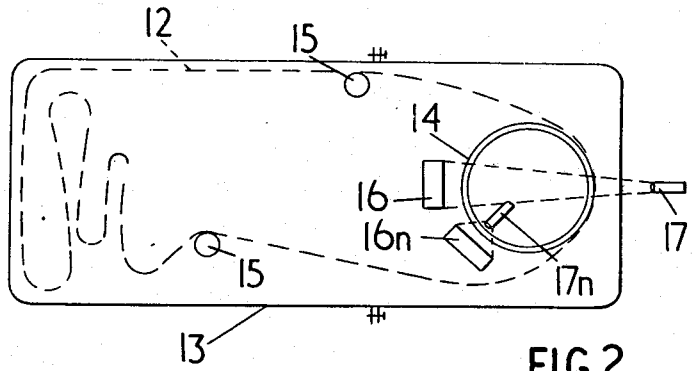
FIG. 2 is a diagrammatic illustration of a pattern band and associated parts.

The FIG. 1 shows the circuitry, which will be described hereinafter, enabling the information stored on a pattern band 12 to be converted into pulses for operation of the selector elements 9. Referring also to FIG. 2, it can be seen that the pattern band 12 is mounted in a generally conventional canister 13 and is in the form of an endless band running over a drum 14 driven by suitable gearing from the cylinder 1. The band 12 also runs over suitable guide rollers 15. A light source 16 illuminates the band through the drum, and reading means or photodiodes 17 are located in strategic positions to collect light transmitted from the source 16 through suitably positioned holes in the pattern band.

Figure 3:
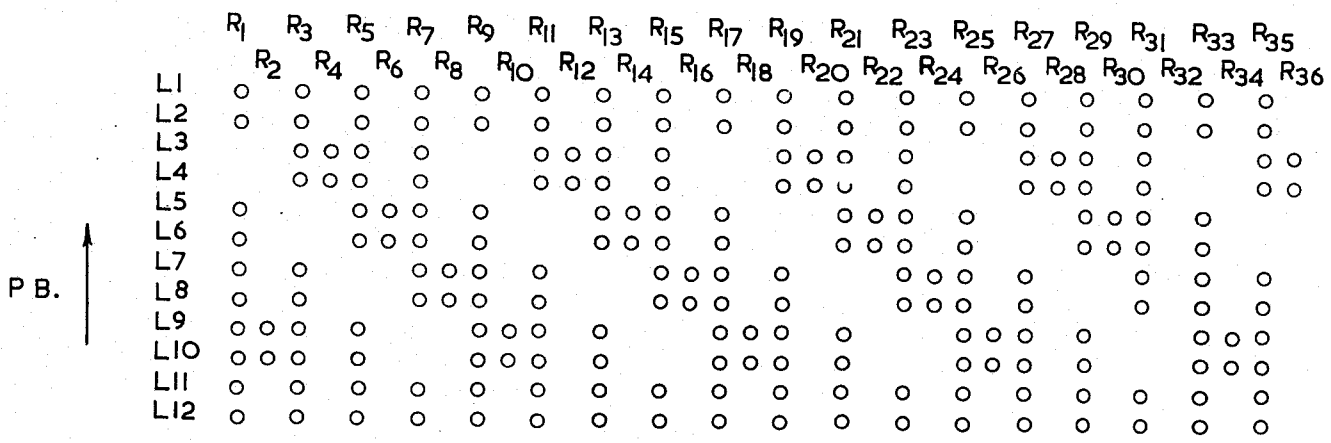
FIG. 3 illustrates a portion of the pattern band.

FIG. 3 shows a section of the pattern band 12. 36 rows of holes or information spots are shown as R1 to R36. The holes are punched according to the desired pattern in rows R1 to R36, and the pattern band 12 is considered to be progressed step by step in the direction of arrow 'PB'. The lateral lines of holes are indicated as L1, L2, L3, each line representing a 'reading' for each step of the pattern band.

If, in any of the 36 rows R1 to R36, a hole is presented to a photodiode 17, then an impulse is transmitted towards the group of selectors 9 associated with the pattern unit controlled by the row in which the hole appears. This impulse will initiate movement of a particular one of the stack of six selector elements into a butt path or, if it is already in a butt path, the impulse will cause it to remain there. If, on the other hand, there is a blank instead of a hole presented in any of the 36 rows R1 to R36, no impulse can be transmitted by the related photodiode 17 and therefore, in order to remove a selector element from a butt path, an appropriate opposite pulse must be generated. Such a pulse is referred to herein as a negative pulse, regardless of its polarity.

Figure 11:
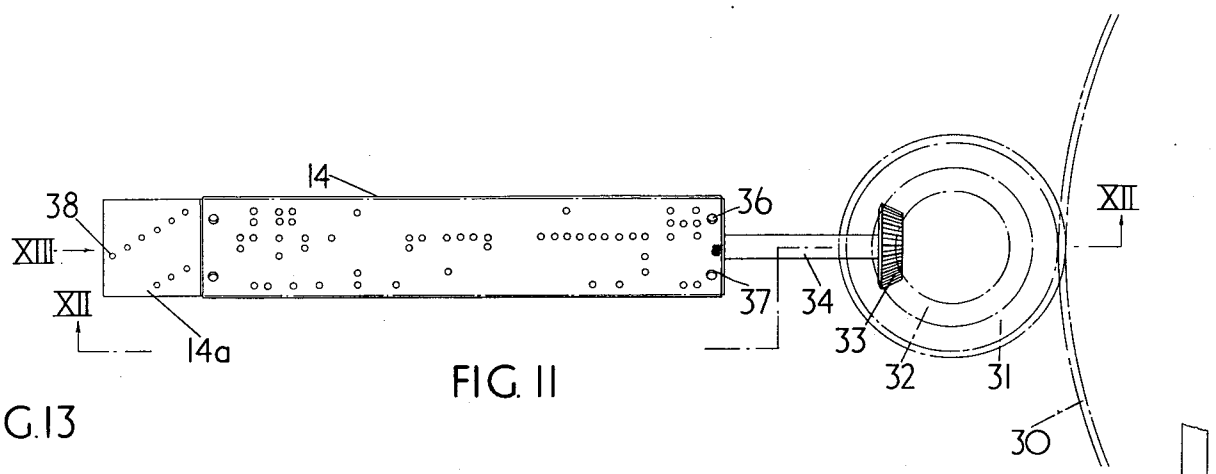
FIG. 11 is a plan view of the drive mechanism of the reading head.
Figure 12:
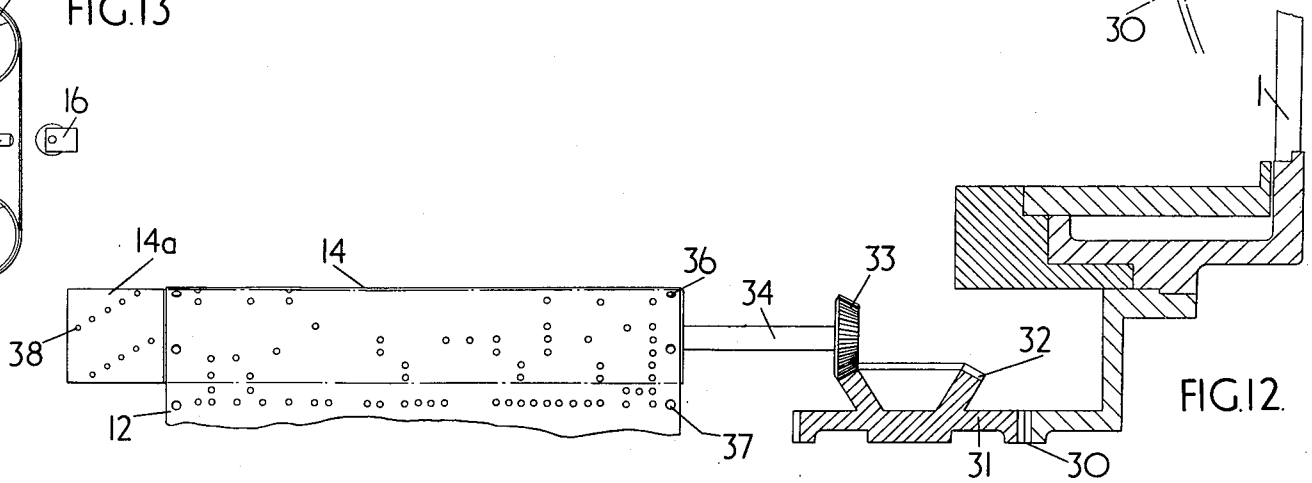
FIG. 12 is a section on the line XII—XII of FIG. 11.

It can be seen from FIGS. 11 and 12 that the drum 14 has an extension 14*a* which acts as a carrier for information spots in the form of holes 38 which are arranged sequentially in each of six rows, and these holes 38 are provided for the purpose of initiating the negative pulses, and also ensuring the correct cycling of the operation of the selector elements in the various groups. It can be seen from FIGS. 1 and 2 that a light source 16*n* is provided outside the drum extension 14*a* and a row of reading means or photodiodes 17*n* is provided within the drum and is arranged to sense the passage of the holes 38. It is to be noted that the pattern band 12 does not pass over the extension of the drum 14*a* at which the holes 38 are read. The impulse derived from the hole 38 will also be triggering the circuit so that the pulses from the holes in the rows R1 to R36 are passed to the selector units. The circuit arrangement is thus such that an impulse initiated by any hole in rows R1 to R36 will, in conjunction with the impulse initiated by a single hole 38, present a pulse to move the selector into the butt engaging path. It will be apparent that such an arrangement provides that a definite signal is transmitted to cause the selector elements to be disposed either in butt engaging position or out of engaging position, such signals being initiated by a minimum number of photocells and pattern holes.

It has been shown that each of the thirty-six rows R1 to R36, coupled with holes 38, control each of the thirty-six patterning units, and that at each 'reading' of a lateral line L of holes and blanks, one impulse is transmitted to each patterning unit. Since, each 'reading' can influence only one selector element of the group of six in each pattern unit, it is necessary to provide cycling means capable of routing the impulses initiated by the rows R1 to R36 so that on successive readings the impulses can influence different ones of all six selector elements in each pattern unit. This function is achieved by staggering the holes 38 in six different rows.

It should be pointed out that the composition of the pattern band can be affected by the number of needles employed in the knitting machine cylinder. In the case of a machine in which the operating butts for the needles are arranged in groups of six it is obvious that the simplest arrangement can be obtained if the number of needles in the cylinder will divide exactly by six. In order to give a better appreciation of this and also of the foregoing description, it will be found useful to consider a specific arrangement of the pattern band by way of example and with reference to FIG. 4, as applied to a knitting machine having a conveniently divisible number of needles. Although a typical machine is one having well over one thousand needles, e.g. 1728, and 36 feeding stations, for purposes of illustration only in this example, it will be preferable to consider a much smaller number of needles and feeding stations. Such a number of needles is 144, which is exactly divisible to provide 24 groups having six needles, each with one butt, in each group. Again, a convenient number of feeding stations and patterning units is 12, thus there will be two identical groups of butts controlling 12 needles between each patterning unit. Each unit has six butt-selecting elements.

Figure 4:
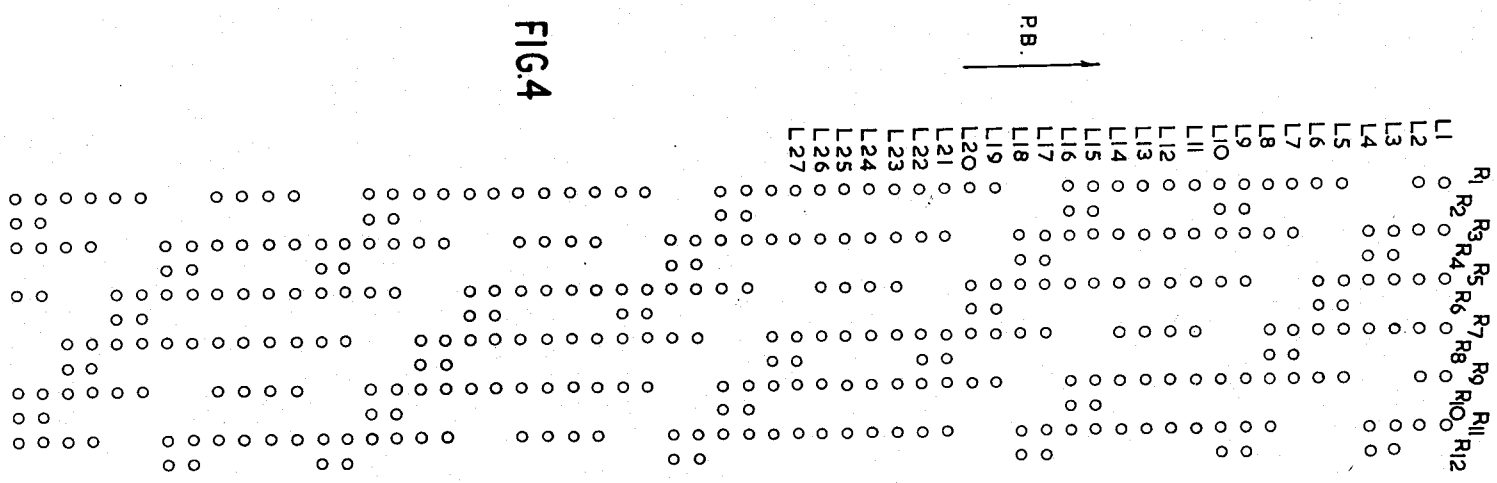
FIG. 4 illustrates a portion of a simplified form of pattern band.

The portion of pattern band shown in FIG. 4 has been composed to provide a very simple example to illustrate the system of control as applied to the 12 patterning units. A repetitive pattern has been devised solely for ease of explanation, but it will be realised that the patterning scope provided by needle selection is unlimited when every needle can be individually controlled as in the present invention and the pattern width is only limited by the width of the fabric (or circumference of circularly knit fabric) and the length of the pattern band.

In FIG. 4 there are shown 12 rows R1 to R12 containing punched holes and blanks. Each of these rows controls one patterning unit situated prior to a feeding station. Considering the pattern band to be advanced in the direction of arrow PB, the first line to be read will be L1 which has holes in rows R1, R3, R5, R7, R9 and R11. The holes in rows R1, R3, R5, R7, R9 and R11 will initiate pulses in the first, third, fifth, seventh, ninth and eleventh patterning units to cause movement of the top selector element of each of these units to butt engaging position. If any of these top elements are already in butt engaging position the impulse will cause them to remain there. At the same time a hole 38 will initiate an impulse in the circuits of all the 12 patterning units, but the impulses in the circuits associated with rows R1, R3, R5, R7, R9 and R11 will be matched by the impulses initiated by the holes in these rows so that the corresponding selectors will be moved into butt engaging path. The hole 38 will also initiate unmatched impulses in the second, fourth, sixth, eighth tenth, and twelfth units to cause any top selector element in these units to be moved from the butt path should a selector have been left in the butt path by a previous reading.

Figure 5:
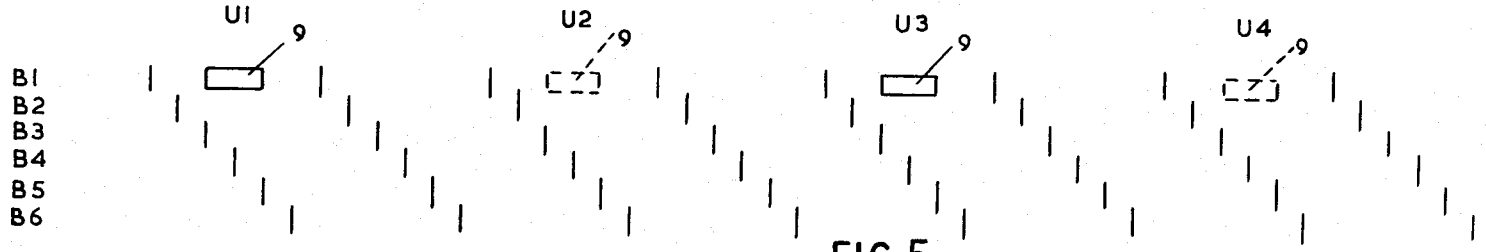
FIGS. 5 to 10 are diagrammatic showings of part of a developed needle cylinder illustrating the steps of operation of the needle selectors under control of the band shown in FIG. 4.
Figures 8, 9, 10:
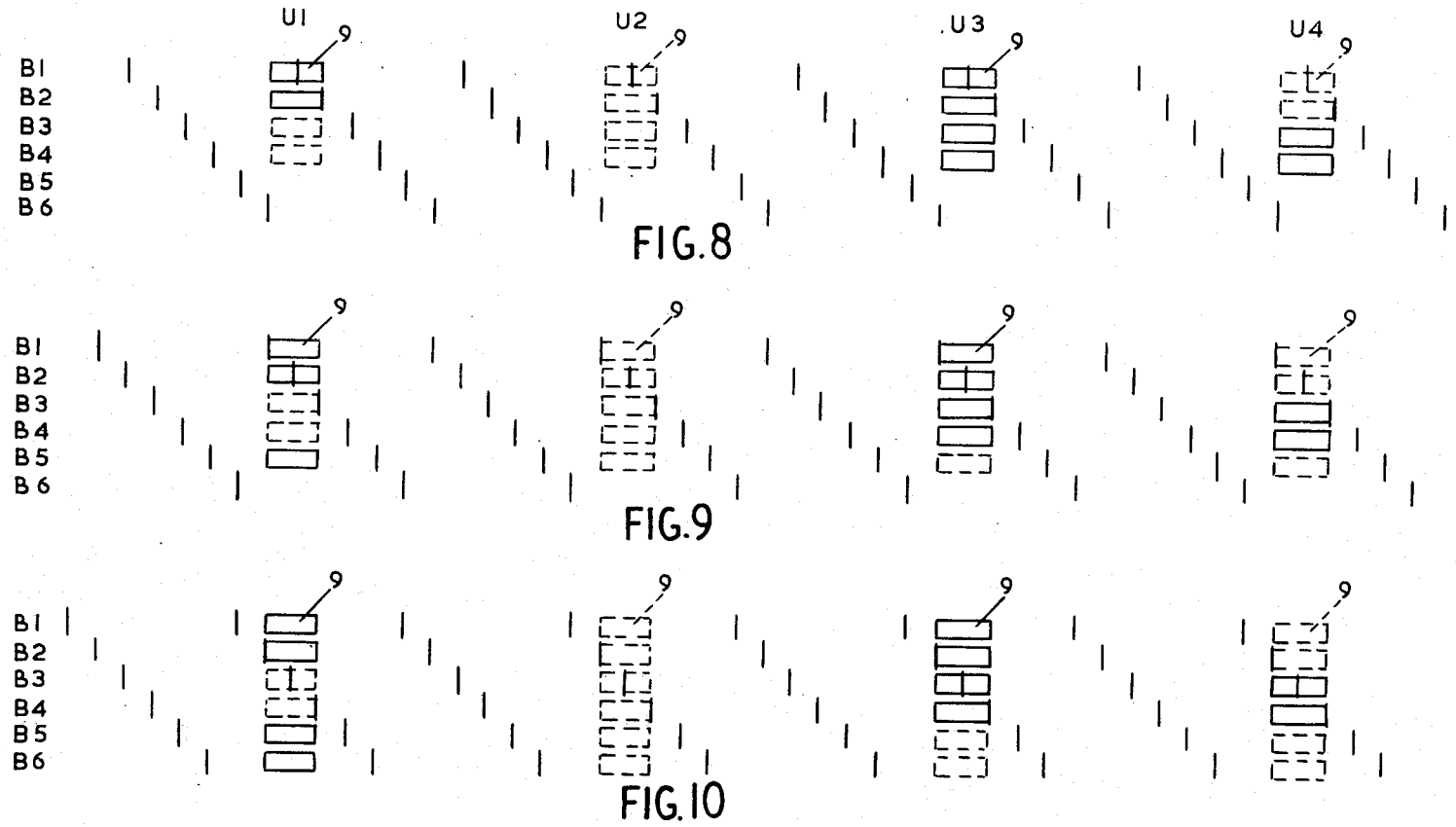

In the developed view FIG. 5 which shows diagrammatically a section of the needle butt layout of the needle cylinder, four of the 12 patterning units are represented by U1, U2, U3 and U4. The needle butts are shown at levels B1, B2, B3, B4, B5 and B6. Due to the first reading of the pattern band as just described, the top selector elements 9 of units U1, U3 will be disposed in the butt path B1 while the top selectors 9 (shown dotted) of units U2, U4 are in a withdrawn position. In order to avoid confusion, the selector elements 9 relative to each level B1 to B6 are progressively added in the FIGS. 5 to 10, in the order in which they are referred to in the following description. It should be realised, however, that in actual fact all the six selector elements in each of the units U1 to U4 would be present in FIGS. 5 to 9 as shown in FIG. 10 but not necessarily in the same pattern arrangement.

Figure 6:
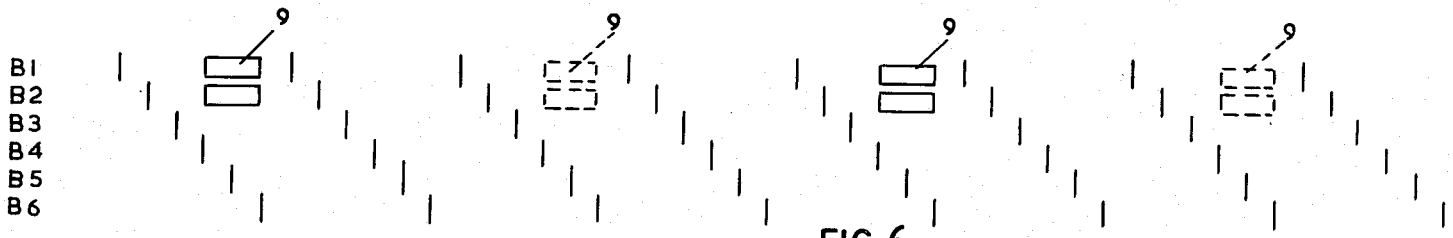
Figure 7:
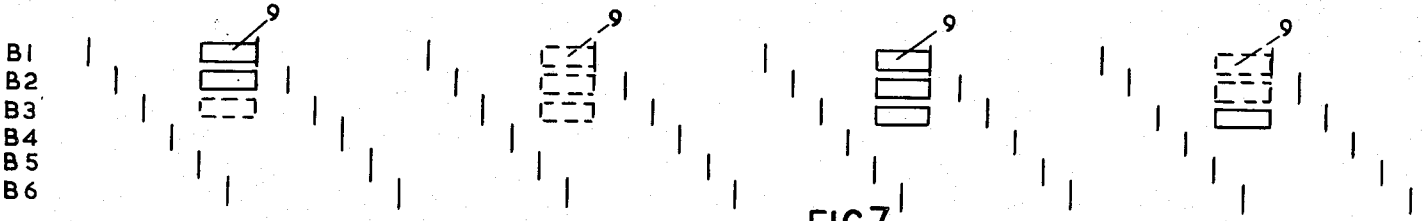

In this example the timing of the impulses initiated by the reader mechanism is such that the selector elements 9 are moved either into or away from butt engaging position approximately midway between any two butts at any of the levels B1 to B6, and with this in mind the second reading of the pattern band may now be considered with reference to FIG. 6.

At the instant of reading the second line L2 of the pattern band the needle cylinder will have revolved through a distance equivalent to one needle pitch and as shown in FIG. 6, the butts at the top level B1 will have moved one pitch closer to the selector elements 9, the direction of movement of the needle cylinder being from right to left in the figures. Because the line L2 of the pattern band is identical to line L1, the impulses initiated by the 'reading' of this line will affect the same pattern units that were affected by the previous reading, but this time, because of the circuit switching means previously mentioned for routing the impulses, the reading of line L2 will cause the selector elements at the level B2 to be operated. Thus the selector elements 9 at the butt level B2 will be disposed as shown in FIG. 6.

The reading of line L3 of the pattern band will occur when the needle cylinder has rotated a further needle pitch distance. The circuit switching means will route the impulses given by the reading of line L3 to the selector elements at the butt level B3 (see FIG. 7). As shown in FIG. 4, line L3 shows a change in the pattern band. A blank has appeared in row R1 and therefore the appropriate hole 38 will initiate an impulse to unit U1 to withdraw the selector element at the level B3 should it have been left in the butt path. The blank in row R2 will similarly be controlled by hole 38. The holes in rows R3, R4, R5, R7, R11 and R12 will initiate impulses (matched by impulses initiated by the hole 38) to their respective units to cause their selector elements at level B3 to be disposed in the butt path and the blanks in the remaining rows R6, R8, R9 and R10 will be controlled by hole 38 to initiate impulses to their respective units to cause their selector elements at level B3 to be disposed out of the butt path. The result of reading line L3 as it affects units U1 to U4 is shown at level B3 in FIG. 7. Line L4 is a repeat of L3 and therefore the selector elements at butt level B4 are operated similarly to those at level B3 and the result on units U1 to U4 is shown in FIG. 8.

Line L5 shows a change in the pattern band and the result of this change is that at butt level B5 the selector elements of the first, fifth, sixth, seventh and ninth units are disposed in the butt path and the selector elements of the other units are disposed out of the butt path (see FIG. 9).

Line L6 is a repeat of L5 and therefore the selector elements at butt level B6 are operated similarly to those at level B5, and the result on units U1 to U4 is shown in FIG. 10.

It will now be noted that all six levels of selector elements in all 12 units have been operated by reading the first six lines of the pattern band. The needle cylinder has rotated through six needle pitches and each alternate group of diagonally disposed butts can be influenced. The reading of the next six lines of the pattern band, (i.e. lines L7 to L12) will cause progressive re-disposition of all six levels of the selector elements during the rotation of the needle cylinder through a further six needle pitches, thus enabling each intermediate group of diagonally disposed butts to come under the influence of the re-disposed selector elements.

By this means all 12 needles between each of the 12 knitting stations can be individually selected before passing through the stations, and in one revolution of the needle cylinder each of the 144 needles can be selected to react differently at each of the 12 feeding stations.

When applying the system to a machine having say 48 knitting stations and 1728 needles, the needles would have their associated butts arranged in 288 groups, having six butts in each group, and there would be six groups (36 needles) between each knitting station.

It will be obvious that the reading of the pattern band must be co-ordinated with the passage of butts past the patterning units, and this may be done in a number of ways. One way is to drive the band through the medium of sprocket holes and provide only one sprocket hole for every six lines or readings of the band. If the sprocket drive is substantially synchronised with the cylinder drive, the insertion and retraction of the selector elements can always be obtained in correct relationship to the butts.

For instance, should it be more convenient, each stack of selector elements could be disposed diagonally so that they could be inserted between the diagonally disposed groups of butts all at the same instance instead of sequentially. Such an arrangement could then be controlled by either reading the pattern band sequentially and storing the information until six lines have been read and then releasing six impulses at a time to each patterning unit, or the six lines could be read simultaneously and released simultaneously at the appropriately spaced intervals.

A further variation could be to provide that seven lines instead of six lines of the pattern band are read during the passage of each group of six butts past a patterning unit. In this way the first six readings would control the six selector elements as aforesaid and the seventh reading could control some other function of the machine.

It should be realised that in FIGS. 5 to 10, the relationship of the selector elements to the butts is given by way of example only. Other butt-selecting arrangements can of course be used. For instance, it may be desirable to have the butt levels spaced apart sufficiently to allow the selector elements to be moved out of the butt paths into the spaces between the butt levels, as is illustrated in FIG. 1.

Referring now to FIG. 1 the six photodiodes **17*n* are all illustrated, and are shown as all co-operating with a single light source 16*n*. Each of the photodiodes 17*n* feeds its pulses through a trigger circuit 18 which gives the pulse a steep rise and a steep fall. This pulse is sent to a monostable circuit 19 actuated by the rise of the pulse to emit a pulse of a fixed length, for example two milliseconds. This fixed length pulse is fed to a buffer stage 20 having multiple outputs. It will be appreciated that there are six buffer stages such as 20, one connected to each of the photodiodes 17*n*, and that each of these buffer stages is connected as an input to one logic drive amplifier 21** in each group of such amplifiers associated with a group of selectors. By this means, the first selectors in all the groups receive pulses simultaneously, and the second selectors receive the next pulse, and so on through the groups. After the last selector in each group has received its pulse, the next pulse is fed to the first selector.

It will be further appreciated that there is one photodiode 17 associated with each of the rows R1, R2 . . . R36 illustrated on the pattern band shown in FIG. 3. Only one of these photodiodes 17 is shown in FIG. 1 for clarity of illustration, namely the photodiode 17 associated with the group 10 of selector elements. A similar photodiode 17 is associated with each of the other groups of selector elements. The photodiode 17 is connected to a buffer stage 22 to isolate it from the multiple output leading one to each of the six logic drive amplifiers 21 associated with the group 10. Each of these outputs constitutes another input to the logic drive amplifier.

Figure 14:
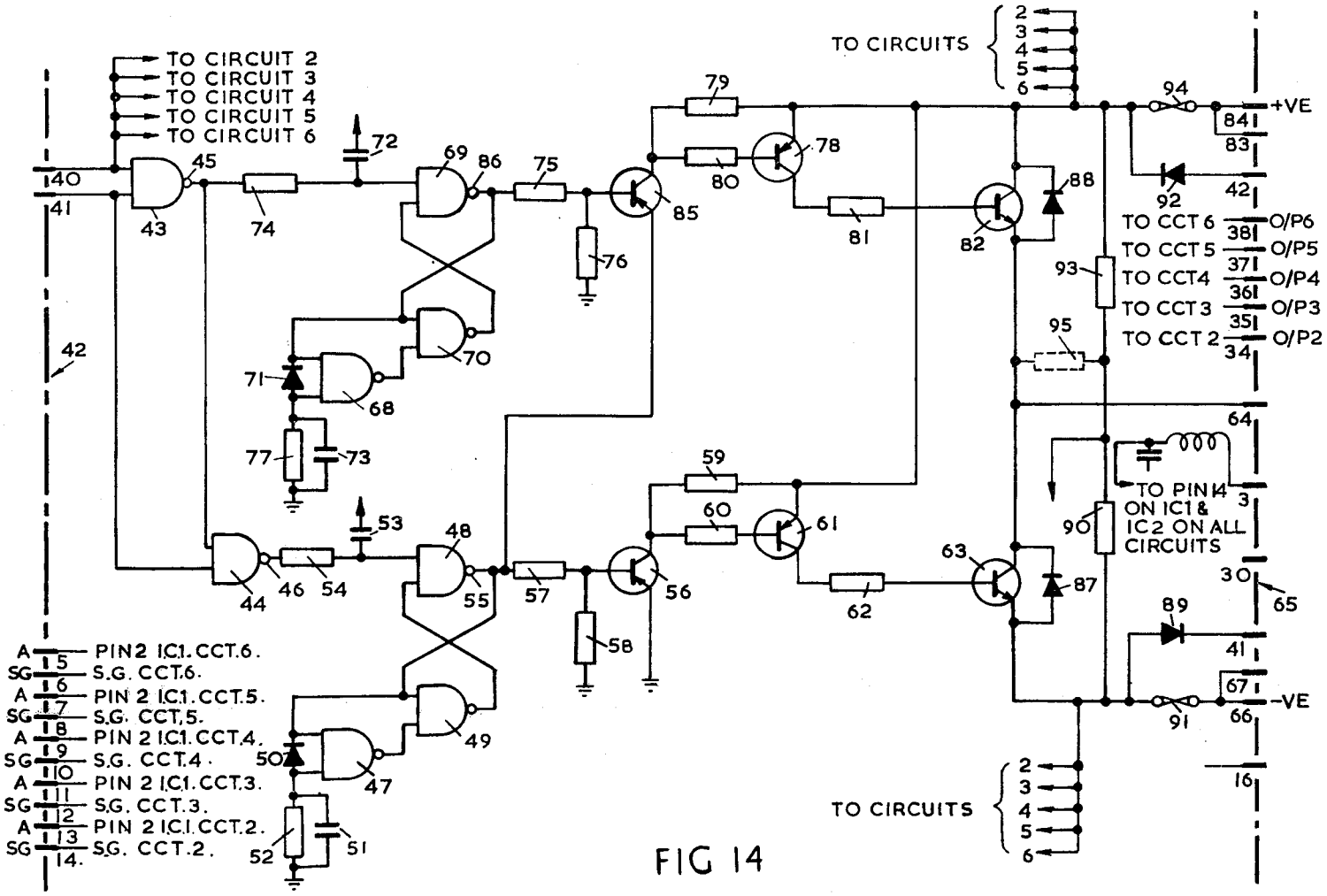
FIG. 14 is a detailed circuit diagram of one of the logic elements illustrated in FIG. 1.

The operation of each logic drive amplifier 21 is such that if there is an input from the buffer stage 22 which is not matched by the regular input from the buffer stage 20, then there is no output signal. If there is a matching signal on each of the inputs, then there is an output signal of polarity such as to move the associated selector element into butt-engaging position to cause retraction of the jack 4 into the trick 3. This gives rise to a miss, and the type of pulse is referred to in this description as a positive pulse, regardless of its polarity. If there is no input from a buffer stage 22, but there is an input from the buffer stage 20, then the logic drive amplifier is designed to give a pulse of opposite polarity, hereinafter referred to as the negative pulse, which will move the selector element to butt-missing position, or retain it in such position so that the needle will in fact knit. The logic drive amplifier is illustrated in FIG. 14 and will be described in more detail hereinafter.

It will be appreciated that by providing six photodiodes 17*n* which are energized in turn, the necessity for providing a separate cycling switch or switching arrangement is avoided.

It will be appreciated that the arrangement is generally such that one of the photo diodes 17*n* is illuminated at substantially the same time that the photodiodes 17 are illuminated through the holes in the pattern band.

FIG. 1 also shows monitoring photodiodes 17*d*, one for each of the light sources 16 and 16*n*, which feed their outputs to light intensity regulators 25.

Upon failure or incipient failure of the light source 16 or 16*n*, the light intensity regulator will emit an alarm signal which can be used to light a warning light and, or alternatively, to switch off the knitting machine until the strength of the light source 16 or 16*n*, is rectified.

The purpose of each logic drive amplifier 21, as part of the pattern selection system on the circular knitting machine, is to provide a fixed duration pulse of either positive or negative polarity (depicted in FIG. 1), (irrespective of machine speed) to be operated by photoelectric means attached to and driven by the knitting machine.

Referring now to FIG. 14, signal inputs to the logic drive amplifier 21 are in the form of high (Logic 1) level voltages on slots 40 and 41 of an edge connector 42. The signal on slot 40 is a pulse derived from the appropriate pattern photodiode 17 and it is simultaneously fed to all six logic drive amplifiers 21. The two signal inputs on slots 40 and 41 are fed to integrated circuits 43 and 44 which are standard dual NAND gates. The amplifier 21 is designed such that the output signals from these gates or circuits 43 and 44 appearing at terminals 45 and 46 take the form of a low (Logic 0) level voltage. Amplifier 21 is also designed such that an output can only occur at either of terminals 45 and 46 in the presence of an input on slot 41.

When an input is presented to slot 41, without an input on slot 40, an output will occur at terminal 46 only. Alternatively, if together with the input on slot 41 there is also present an input on slot 40, then an output will occur at terminal 45 only.

When there is no signal at slots 40 and 41, then both terminals 45 and 46 are at the normal high level (logic 1) level.

Considering integrated circuits 47, 48 and 49 and diode 50. These are standard dual NAND gates arranged in a conventional monostable configuration, such that on the reception of a negative going voltage gradient (i.e. the appearance of the low level output voltage) an output pulse is produced, the time duration of which is determined by capacitor 51 and resistor 52. In this manner an initiating signal of approximately 0.5 ms. is lengthened to approximately 3.5 ms. which, after amplification, is used to drive an actuator coil. The reason for a lengthened pulse is to ensure that the selectors 9 will settle down after being switched. It should be appreciated that with selector elements of this nature and with the speed of operation necessarily being in microseconds, there will be a considerable "whipping" effect present in the two arms of the selectors 9 as they undergo a selection. The lengthened signals ensure that the arms of the selectors 9 will settle down quickly so that any tendency for a misselection due to the "whipping" effect is obviated.

Capacitor 53 and resistor 54 are designed to filter noise from triggering the monostable circuit into giving incorrect outputs.

The output from the monostable circuit appears at terminal 55 in the form of a high (Logic 1) level pulse which is used to switch a transistor 56 via a resistor 57. Resistor 58 ensures that the transistor 56 remains OFF at all other times.

Transistor 56 provides both amplification and an interface between the integrated circuit voltage level and the higher level used in the succeeding stages. The output of transistor 56, as formed across a resistor 59, gives via a resistor 60 the base drive required for a transistor 61.

Transistor 61 provides further amplification, and its collector current output via a resistor 62 provides base drive for a power output transistor 63.

The transistor 63, when turned ON, effectively connects the amplifier output at slot 64 on an edge connector 65, to 20 volts negative at slots 66 and 67 on connector 65. Consequently, an actuator coil, one end connected to slot 64 and one end to ground, will have a current driven through it in a specific direction.

The functioning of integrated circuits 68, 69 and 70 and diode 71 are exactly comparable to the above, also capacitors 72 and 73, and resistors 74, 75, 76 and 77.

Transistor 78, resistors 79, 80 and 81 are comparable to transistor 61 and resistors 59, 60 and 62. Transistor 82 performs a similar function to 63 but for convenience is connected in the Emitter Follower mode. When switched ON it effectively connects the amplifier outputs (Slot 64) to 20 volts positive (Slots 83 and 84). Therefore an actuator coil connected as before will have a current driven through it in the reverse direction.

In order to prevent later stages from damage in the event of input phasing errors, it is arranged that transistor 85 cannot turn ON simultaneously with transistor 56. This is achieved by driving the base of 85 from the integrated circuit output at terminal 86 via resistor 75 similarly to before, but connecting the emitter to integrated circuit output 55. In the event of both outputs 55 and 86 being ON simultaneously, transistor 85 will not receive the minimum base emitter voltage (V-BE) necessary to turn it ON. As a further precaution to ensure that the two outputs are of a similar level it is arranged that gates 48 and 69 are in the same integrated circuit package.

Diodes 87 and 88 are intended to quench the reactive voltage caused by the inductive load of the actuator coil.

Diode 89 and resistor 90 form part of a multiple 'OR' gate which, employing circuitry elsewhere detects the destruction of fuse 91. Diode 92 and resistor 93 perform similarly for fuse 94.

Resistor 95, if fitted, is a simulated load to assist servicing.

The other five logic drive amplifiers 21 in the set are also connected to the edge connector 65.

The gearing drive in the drum 14 is shown in FIGS. 11 and 12 and comprises a gear 30 carried by the cylinder 1 and meshing with a pinion 31 solid with a bevel gear 32. The bevel 32 drives a meshing bevel gear 33 on a drive shaft 34 for the drum 14. It can also be seen that the drum 14 drives the pattern band 12 by means of sprocket teeth 36 cooperating with sprocket holes 37.

It will be seen that the sprocket holes and teeth are spaced at a pitch equal to six pitches of the holes forming information spots. Naturally, this number would normally be chosen to be equal to the number of selectors in a group.

Figure 13:
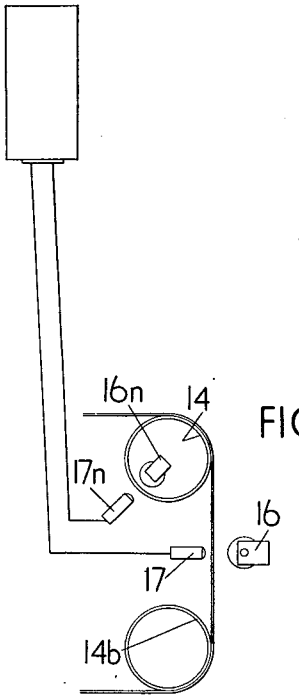
FIG. 13 is an elevation viewed in the direction of the arrow XIII of FIG. 11 of a modified form of drum.

FIG. 13 shows a modified form of drive for the band 12, in which it passes over a second drive 14*b*, which may be driven by the drive for drum 14, and the light source 16 and diodes 17 are located between the drums 14 and 14*b*.

Various other modifications may be made within the scope of the invention.

It will be appreciated that the holes 38 in the drum 14*a* and the associated photodiodes 17*n* may be replaced by alternative means for generating the pulses upon rotation of the drum. As examples, mention may be made of magnetically operated reed switches, or other magnetic impulse generators.

Further, the holes 38 may be replaced by similar staggered holes in the appropriate number of rows and provided in the pattern bands, that the extra width of the pattern band acts as carrier for the secondary information spots.

Also, where 36 feeds are referred to, it is quite possible to use other numbers, e.g., 48 feeds. In addition, the selector elements 9 are shown as moving above the butts into butt-engaging position. Naturally, movement below would also fall within the scope of the invention, as would a form of retraction.

We claim:

1. A pattern control arrangement for a knitting machine, comprising in combination: needles, cam means for lifting said needles, cam-engaging butts associated with said needles, butts for controlling the location of said cam-engaging butts in or out of cam-engaging position, selectors for engaging said controlling butts, a pattern band, magnetic tape or the like carrying information spots, reading means for moving said selectors into or out of butt-engaging position in accordance with said information spots on said pattern band, tape or the like, said reading means including means for providing pulses for moving said selectors into butt-engaging position when required to move into or remain in that position and also means for providing pulses to move said selectors out of butt-engaging position when required to move out of or remain out of that position, drive means for said pattern band, tape or the like, carrier means driven by said drive means and having secondary information spots thereon which are adapted to be read by the reading means to act as the source of said pulses for moving said selectors out of butt-engaging position, said selectors being arranged in groups of which one selector is to be actuated at each reading of said pattern band, tape or the like said carrier means having said secondary information spots arranged thereon in a number of rows equal to the number of selectors in each group, the reading means includes a logic amplifier for each selector, the said logic amplifier having a first input from the principal information spots on the pattern band, tape or the like and relating to the pattern, and a second input from the said secondary information spots arranged in a number of rows equal to the number of selectors in a group, the said logic amplifier being such as to give an amplified output following the detection of a second input, the polarity of the amplified outputs being controlled by the detection of the existence or otherwise of a signal at the first input, there being no amplified output if no signal is detected at the second input, an actuator operatively connected to and controlling the movement of said one selector to be actuated at each reading position of said pattern band for moving said one selector into and out of butt-engaging position, a first source of a fixed duration pulse having a predetermined magnitude and being of positive polarity, a second source of a fixed duration pulse having the same fixed duration as the pulse of said first source and having a predetermined magnitude equal to the magnitude of said pulse from said first source but being of negative polarity, said logic amplifier including means for selectively applying said positive pulse from said first source and said negative pulse from said second source to said actuator for moving said one selector into or out of butt-engaging position, respectively, or vice versa.

2. A pattern control arrangement as claimed in claim 1, wherein the said drive means includes a drum driving the pattern band, tape or the like and having an extension carrying the secondary information spots.

3. A pattern control arrangement as claimed in claim 1, for a multi feed knitting machine having a group of selectors associated with each feed point, the pattern band, tape or the like having a row of drive pulse information spots associated with each group of selectors, the presence or absence of an information spot at a particular position in the row determining the required position of the selector, the signals from the principal information spots in a row being fed as a first input to all of the logic drive amplifiers pertaining to the associated group of selectors and the signals from the secondary information spots being fed to selected ones of the selectors of each group as second input.

* * * * *